US007667596B2

(12) United States Patent
Ozdemir et al.

(10) Patent No.: US 7,667,596 B2
(45) Date of Patent: Feb. 23, 2010

(54) METHOD AND SYSTEM FOR SCORING SURVEILLANCE SYSTEM FOOTAGE

(75) Inventors: Hasan Timucin Ozdemir, Plainsboro, NJ (US); Sameer Kibey, College Park, MD (US); Lipin Liu, Belle Mead, NJ (US); Kuo Chu Lee, Princeton Junction, NJ (US); Supraja Mosali, Plainsboro, NJ (US); Namsoo Joo, East Brunswick, NJ (US); Hongbing Li, Belle Mead, NJ (US); Juan Yu, Cranbury, NJ (US)

(73) Assignee: Panasonic Corporation, Osaka (JP)

( * ) Notice: Subject to any disclaimer, the term of this patent is extended or adjusted under 35 U.S.C. 154(b) by 342 days.

(21) Appl. No.: 11/676,127

(22) Filed: Feb. 16, 2007

(65) Prior Publication Data

US 2008/0201116 A1 Aug. 21, 2008

(51) Int. Cl.
*G08B 13/00* (2006.01)

(52) U.S. Cl. ..... 340/541; 340/572.1; 340/568.1; 340/539.22

(58) Field of Classification Search ..... 340/541, 340/539.22–539.26, 539.32, 568.1, 572.1; 706/45–47

See application file for complete search history.

(56) References Cited

U.S. PATENT DOCUMENTS 5,091,780 A * 2/1992 Pomerleau ..... 348/152
5,261,041 A 11/1993 Susman
5,594,856 A 1/1997 Girard
5,666,157 A 9/1997 Aviv
5,937,092 A 8/1999 Wootton et al.
5,956,424 A 9/1999 Wootton et al.
5,966,074 A 10/1999 Baxter
6,088,042 A 7/2000 Handelman et al.
6,441,734 B1 8/2002 Gutta et al.
6,587,574 B1 7/2003 Jeannin
6,593,852 B2 7/2003 Gutta et al.
6,823,011 B2 11/2004 Divakaran et al.
6,856,249 B2 * 2/2005 Strubbe et al. ..... 340/573.1
6,985,172 B1 1/2006 Rigney et al.
7,023,913 B1 * 4/2006 Monroe ..... 375/240.01
7,068,842 B2 6/2006 Liang et al.
7,076,102 B2 7/2006 Lin et al.

(Continued)

OTHER PUBLICATIONS

W. Hu, T. Tan, L. Wang, S. Maybank: "A Survey on Visual Surveillance of Object Motion and Behaviors"; IEEE Transactions on Systems, Man and Cybernetics, Part C, vol. 34, Issue 3, p. 334-352 (Aug. 2004).

(Continued)

*Primary Examiner*—Daniel Previl
(74) *Attorney, Agent, or Firm*—Harness, Dickey & Pierce, PLC

(57) ABSTRACT

A surveillance system generally includes a data capture module that collects sensor data. A scoring engine module receives the sensor data and computes at least one of an abnormality score and a normalcy score based on the sensor data, at least one dynamically loaded learned data model, and a learned scoring method. A decision making module receives the at least one of the abnormality score and the normalcy score and generates an alert message based on the at least one of the abnormality score and the normalcy score and a learned decision making method to produce progressive behavior and threat detection.

29 Claims, 10 Drawing Sheets

U.S. PATENT DOCUMENTS

| | | | | |
|---|---|---|---|---|
| 7,088,846 | B2 | 8/2006 | Han et al. | |
| 7,095,328 | B1 | 8/2006 | Stern et al. | |
| 7,109,861 | B2 | 9/2006 | Rao | |
| 7,110,569 | B2 | 9/2006 | Brodsky et al. | |
| 7,127,083 | B2 | 10/2006 | Han et al. | |
| 7,136,507 | B2 | 11/2006 | Han et al. | |
| 7,148,912 | B2 | 12/2006 | Han et al. | |
| 7,215,364 | B2 * | 5/2007 | Wachtel et al. | 348/218.1 |
| 7,339,607 | B2 * | 3/2008 | Damabhorn | 348/143 |
| 2005/0104959 | A1 | 5/2005 | Han et al. | |
| 2005/0104960 | A1 | 5/2005 | Han et al. | |
| 2005/0285937 | A1 | 12/2005 | Porikli | |
| 2005/0286774 | A1 | 12/2005 | Porikli | |
| 2007/0008408 | A1 * | 1/2007 | Zehavi | 348/143 |

OTHER PUBLICATIONS

N. Johnson, D. Hogg: "Learning the Distribution of Object Trajectories for Event Recognition"; Proc. British Machine Vision Conference, vol. 2, pp. 583-592 (Sep. 1995).

C. Stauffer, W.E.L. Grimson: "Learning Patterns of Activity Using Real-Time Tracking"; IEEE Transactions on Pattern Analysis and Machine Intelligence, vol. 22, No. 8, (Aug. 2000).

J. Han, M. Kamber: "Data Mining; Concepts and Techniques"; Morgan Kaufmann Publishers (2000), pp. 45-48.

Robert Collins et al.; "A System for Video Surveillance and Monitoring: VSAM Final Report"; CMU-RI-TR-00-12, CMU (2000).

M. Bichsel; "Segmenting Simply Connected Moving Objects in a Static Scene"; IEEE Transactions on Pattern Analysis and Machine Intelligence (PAMI); vol. 16, No. 11, pp. 1138-1142, (1994).

* cited by examiner

METHOD AND SYSTEM FOR SCORING SURVEILLANCE SYSTEM FOOTAGE

FIELD

The present invention relates to methods and systems for automated detection and prediction of the progression of behavior and treat patterns in a real-time, multi-sensor environment.

BACKGROUND

The statements in this section merely provide background information related to the present disclosure and may not constitute prior art.

The recent trend in video surveillance systems is to provide video analysis components that can detect potential threats from live streamed video surveillance data. The detection of potential threats assists a security operator, who monitors the live feed from many cameras, to detect actual threats.

Conventional surveillance systems detect potential threats based on predefined patterns. To operate, each camera requires an operator to manually configure abnormal behavior detection features. When the predetermined abnormal pattern is detected, the system generates an alarm. It often requires substantial efforts in adjusting the sensitivity of multiple detection rules defined to detect specific abnormal patterns such as speeding, against the flow, abnormal flow.

Such systems are inefficient in their operation. For example, the proper configuration of each camera is time consuming, requires professional help, and increases deployment costs. In addition, the definition and configuration of every possible abnormal behavior is not realistically possible due to the fact that there may just be too many to enumerate, to study, and to develop a satisfying solution in all possible contexts.

SUMMARY

Accordingly, a surveillance system is provided. The surveillance system generally includes a data capture module that collects sensor data. A scoring engine module receives the sensor data and computes at least one of an abnormality score and a normalcy score based on the sensor data, at least one dynamically loaded learned data model, and a learned scoring method. A decision making module receives the at least one of the abnormality score and the normalcy score and generates an alert message based on the at least one of the abnormality score and the normalcy score and a learned decision making method to produce progressive behavior and threat detection.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present teachings in any way.

DETAILED DESCRIPTION

Figure 1:
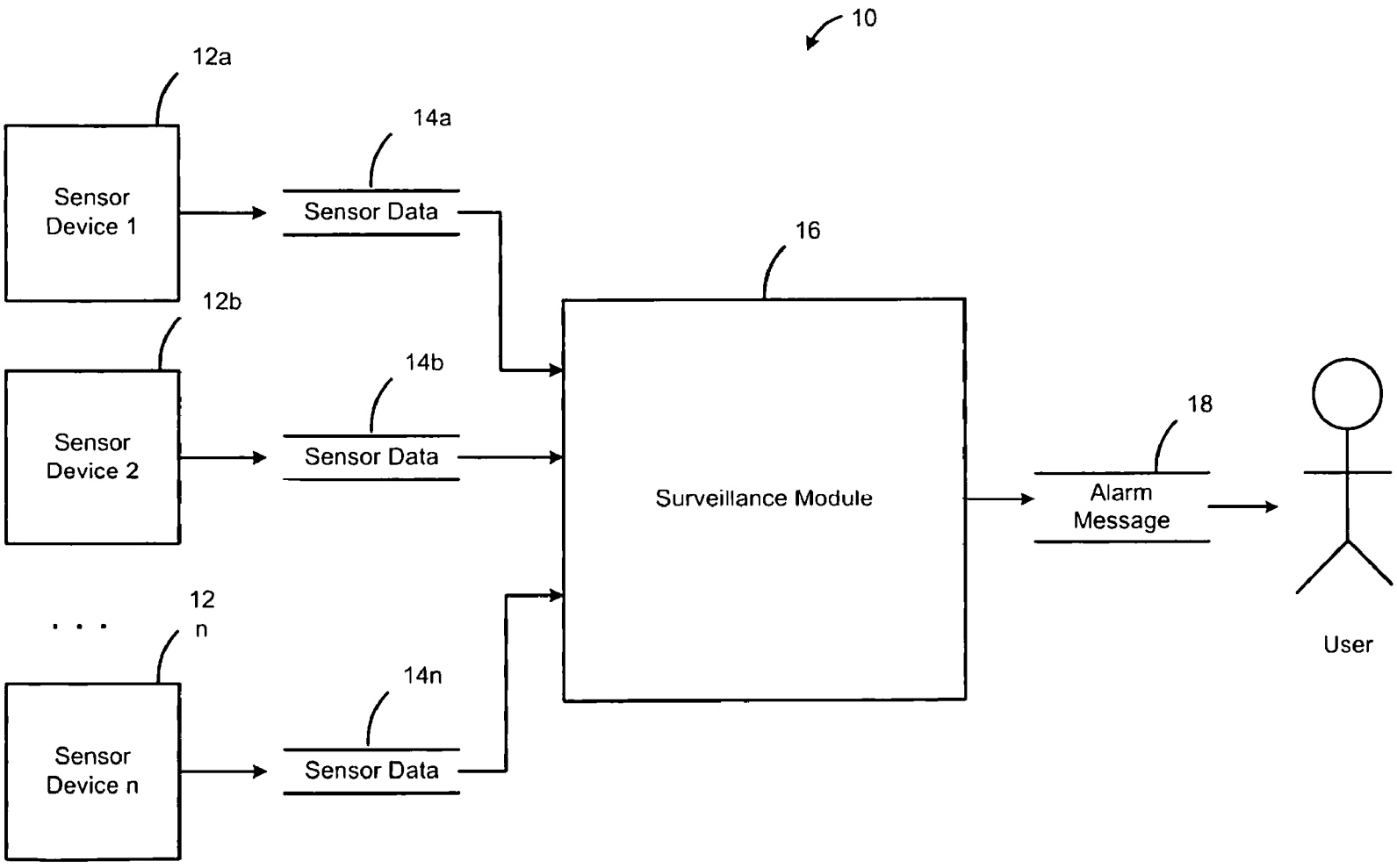
FIG. 1 is a block diagram illustrating an exemplary surveillance system according to various aspects of the present teachings.

The following description is merely exemplary in nature and is not intended to limit the present teachings, their application, or uses. It should be understood that throughout the drawings, corresponding reference numerals indicate like or corresponding parts and features. As used herein, the term module or sub-module can refer to: a processor (shared, dedicated, or group) and memory that executes one or more software or firmware programs, and/or other suitable components that can provide the described functionality and/or combinations thereof.

Referring now to FIG. 1. FIG. 1 depicts an exemplary surveillance system 10 implemented according to various aspects of the present teachings. The exemplary surveillance system 10 includes one or more sensory devices 12*a*-12*n*. The sensory devices 12*a*-12*n* generate sensor data 14*a*-14*n* corresponding to information sensed by the sensory devices 12*a*-12*n*. A surveillance module 16 receives the sensor data 14*a*-14*n* and processes the sensor data 14*a*-14*n* according to various aspects of the present teachings. In general, the surveillance module 16 automatically recognizes suspicious behavior from the sensor data 14*a*-14*n* and generates alarm messages 18 to a user based on a prediction of abnormality scores.

In various aspects of the present teachings, a single surveillance module 16 can be implemented and located remotely from each sensory device 12*a*-12*n* as shown in FIG. 1. In various other aspects of the present teachings, multiple surveillance modules (not shown) can be implemented, one for each sensory device 12*a*-12*n*. In various other aspects of the present teachings, the functionality of the surveillance module 16 may be divided into sub-modules, where some sub-modules are implemented on the sensory devices 12*a*-12*n*, while other sub-modules are implemented remotely from the sensory devices 12*a*-12*n* as shown in FIG. 2.

Figure 2:
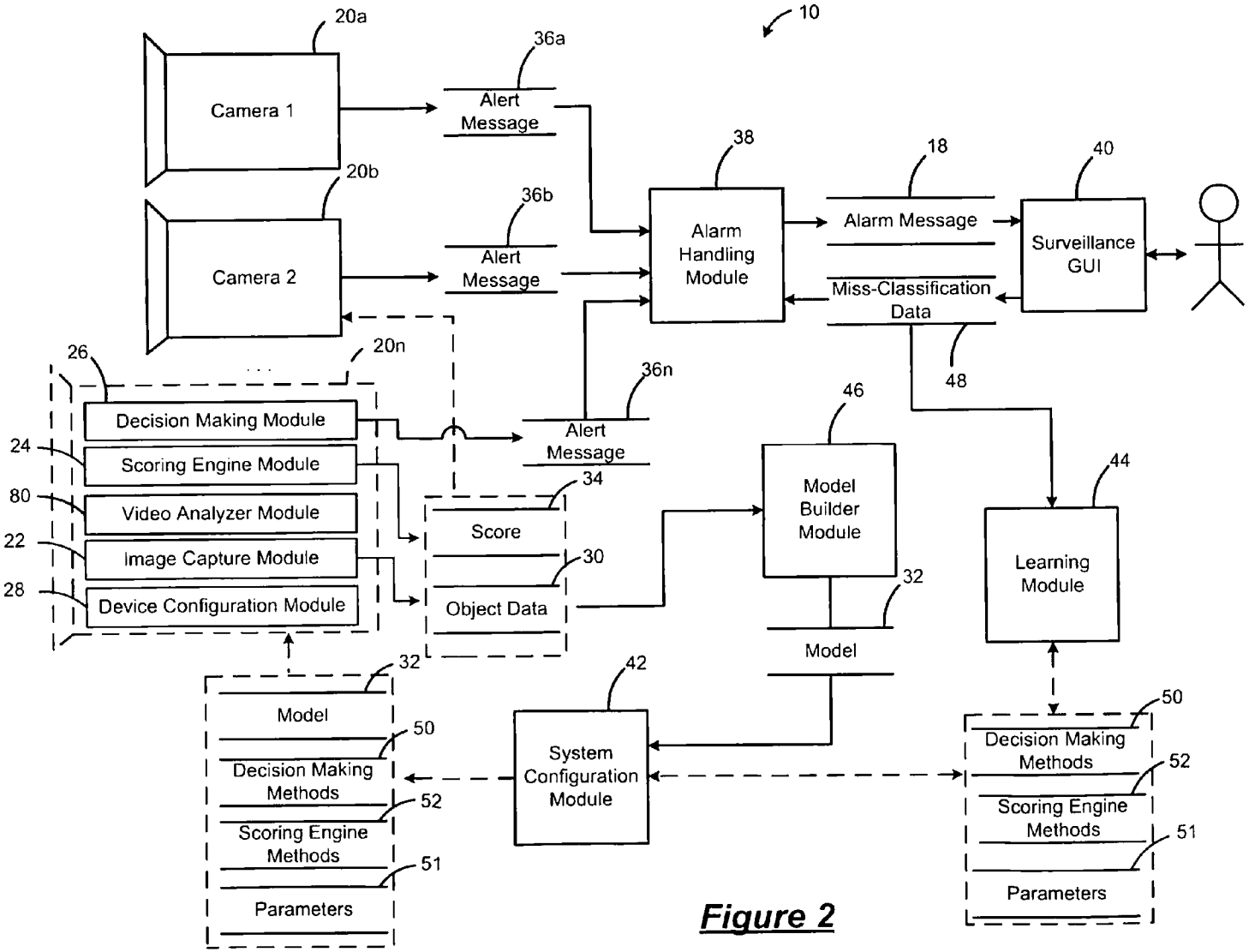
FIG. 2 is a dataflow diagram illustrating exemplary components of the surveillance system according to various aspects of the present teachings.

Referring now to FIG. 2, a dataflow diagram illustrates a more detailed exemplary surveillance system 10 implemented according to various aspects of the present teachings.

For exemplary purposes, the remainder of the disclosure will be discussed in the context of using one or more cameras 20*a*-20*n* as the sensory devices 12*a*-12*n* (FIG. 1). As shown in FIG. 2, each camera 20*a*-20*n* includes an image capture module 22, a video analysis module 80, a scoring engine module 24, a decision making module 26, and a device configuration module 28.

The image capture module 22 collects the sensor data 14*a*-14*n* as image data corresponding to a scene and the video analysis module 80 processes the image data to extract object meta data 30 from the scene. The scoring engine module 24 receives the object meta data 30 and produces a measure of abnormality or normality also referred to as a score 34 based on learned models 32.

The decision making module 26 collects the scores 34 and determines an alert level for the object data 30. The decision making module 26 sends an alert message 36*n* that includes the alert level to external components for further processing. The decision making module 26 can exchange scores 34 and object data 30 with other decision making modules 26 of other cameras 20*a*, 20*b* to generate predictions about objects in motion. The device configuration module 28 loads and manages various models 32, scoring engine methods 52, decision making methods 50, and/or decision making parameters 51 that can be associated with the camera 20*n*.

The surveillance system 10 can also include an alarm handling module 38, a surveillance graphical user interface (GUI) 40, a system configuration module 42, a learning module 44, and a model builder module 46. As shown, such components can be located remotely from the cameras 20*a*-20*n*. The alarm handling module 38 re-evaluates the alert messages 36*a*-36*n* from the cameras 20*a*-20*n* and dispatches the alarm messages 18. The alarm handling module 38 interacts with the user via the surveillance GUI 40 to dispatch the alarm messages 18 and/or collect miss-classification data 48 during alarm acknowledgement operation.

The learning module 44 adapts the decision making methods 50 and parameters 51, and/or the scoring engine methods 52 for each camera 20*a*-20*n* by using the miss-classification data 48 collected from the user. As will be discussed further, the decision making methods 50 are automatically learned and optimized for each scoring method 52 to support the prediction of potential incidents, increase the detection accuracy, and reduce the number of false alarms. The decision making methods 50 fuse the scores 34 as well as previous scoring results, object history data, etc., to reach a final alert decision.

The model builder module 46 builds models 32 representing normal and/or abnormal conditions based on the collected object data 30. The system configuration module 42 manages the models 32, the decision making methods 50 and parameters 51, and the scoring engine methods 52 for the cameras 20*a*-20*n* and uploads the methods and data 32, 50, 51, 52 to the appropriate cameras 20*a*-20*n*.

Figure 3:
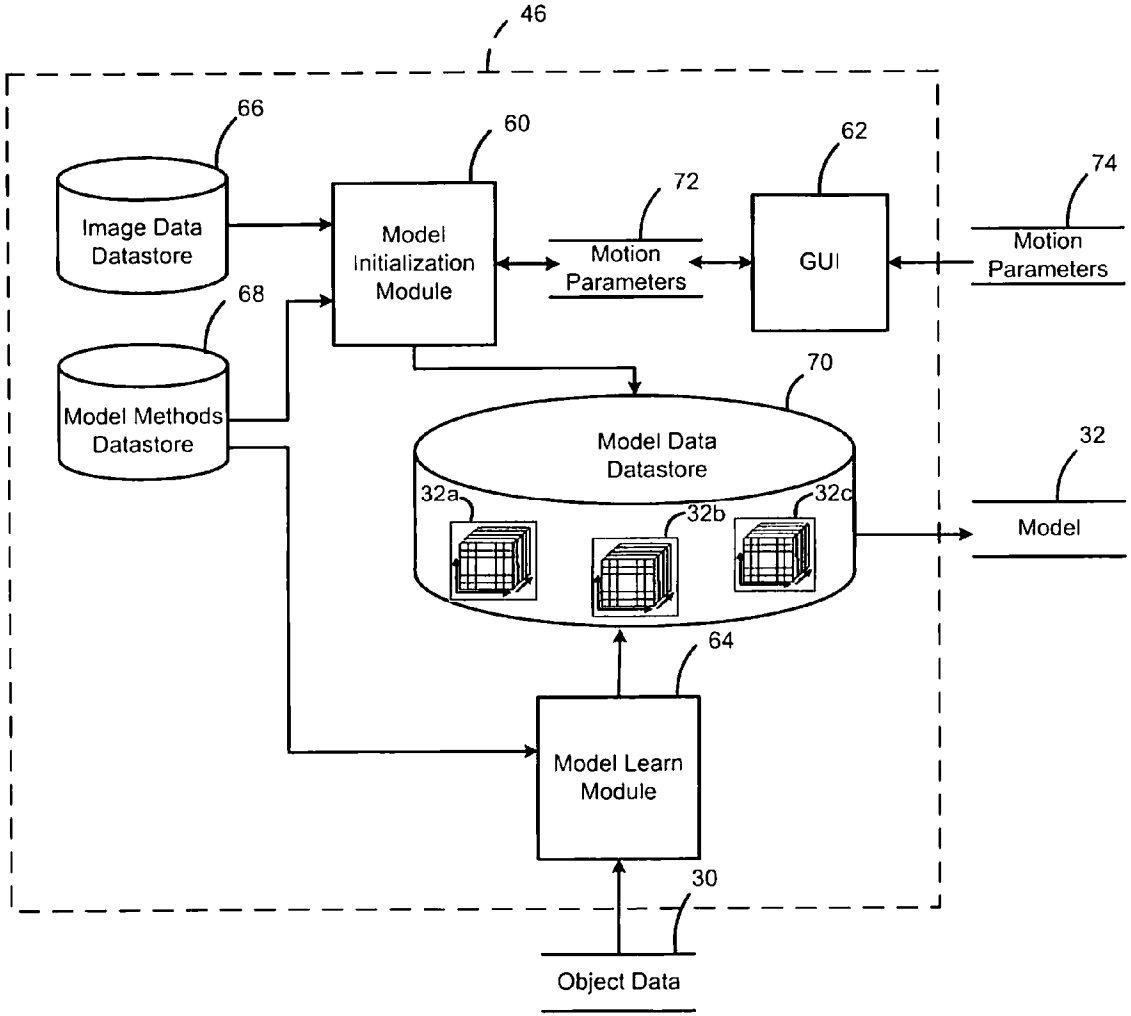
FIG. 3 is a dataflow diagram illustrating an exemplary model builder module of the surveillance system according to various aspects of the present teachings.

Referring now to FIGS. 3 through 10, each Figure provides a more detailed exemplary illustration of the components of the surveillance system 10. More particularly, FIG. 3 is a more detailed exemplary model builder module 46 according to various aspects of the present teachings. As shown, the model builder module 46 includes a model initialization module 60, a model initialization graphical user interface 62, a model learn module 64, an image data datastore 66, a model methods datastore 68, and a model data datastore 70.

The model initialization module 60 captures the domain knowledge from users, and provides initial configuration of system components (i.e., optimized models, optimized scoring functions, optimized decision making functions, etc.). In particular, the model initialization module 60 builds initial models 32 for each camera 20*a*-20*n* (FIG. 2) based on input 74 received from a user via the model initialization GUI 62. For example, the model initialization GUI 62 displays a scene based on image data from a camera thus, providing easy to understand context for user to describe expected motions of objects within the camera field of view. The image data can be received from the image data datastore 66. Using the model initialization GUI 62, the user can enter motion parameters 72 to simulate random trajectories of moving objects in the given scene. The trajectories can represent normal or abnormal conditions. The model initialization module 60 then simulates the trajectories and extracts data from the simulated trajectories in the scene to build the models 32. The generated simulated metadata corresponds to an expected output of a selected video analysis module 80 (FIG. 2).

The model initialization module 60 builds the optimized models 32 from predefined model builder methods stored in the model methods datastore 68. In various aspects of the present teachings, the model initialization module 60 builds the optimal configuration according to a model builder method that selects particular decision making methods 50 (FIG. 2), the configuration parameters 51 (FIG. 2) of decision making methods 50, a set of scoring engine methods 52 (FIG. 2), and/or configuration parameters of scoring engine methods.

In various aspects of the present teachings, the model initialization GUI 62 can provide an option to the user to insert a predefined object into the displayed scene. The model initialization module 60 then simulates the predefined object along the trajectory path for verification purposes. If the user is satisfied with the trajectory paths, the model 32 is stored in the model data datastore 70. Otherwise, the user can iteratively adjust the trajectory parameters and thus, the models 32 until the user is satisfied with the simulation.

Thereafter, the model learn module 64 can automatically adapt the models 32 for each camera 20*a*-20*n* (FIG. 2) by using the collected object data 30 and based on the various model builder methods stored in the model methods datastore 68. The model learn module 64 stores the adapted models 32 in the model data datastore 70.

Figure 4:
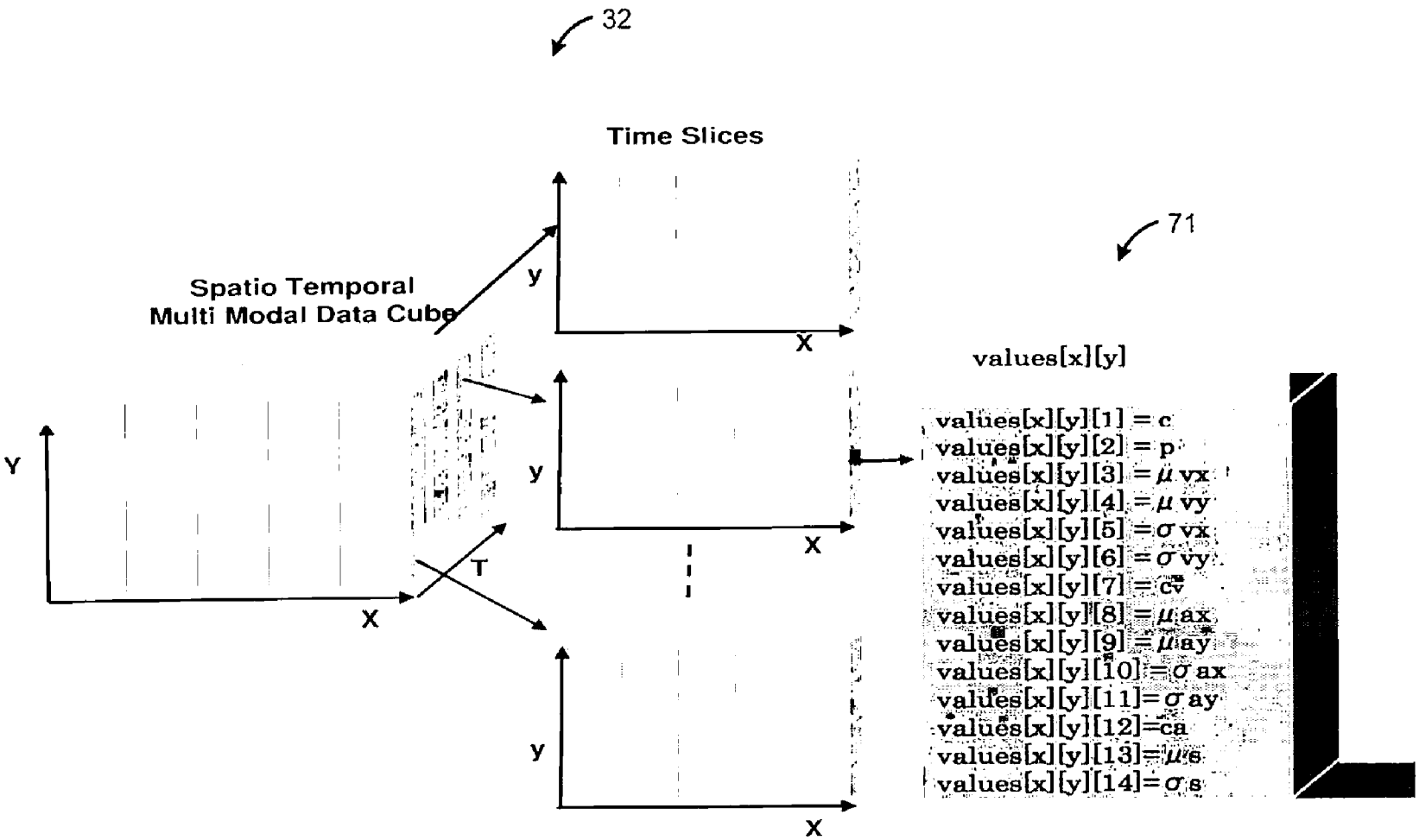
FIG. 4 is an illustration of an exemplary model of the surveillance system according to various aspects of the present teachings.

As can be appreciated, various model building methods can be stored to the model methods datastore 68 to allow the model builder module 46 to build a number of models 32 for each object based on a model type. For example, the various models can include, but are not limited to, a velocity model, an acceleration model, an occurrence model, an entry/exit zones model, a directional speed profile model, and a trajectory model. These models can be built for all observed objects as well as different types of objects. As shown in FIG. 4, the data for each model 32 can be represented as a multi-dimensional array structure 71 (i.e., a data cube) in which each element refers to a specific spatial rectangle (in 3D it is hyper-rectangle) and time interval. In various aspects of the present teachings, the models 32 are represented according to a Predictive Model Markup Language (PMML) and its extended form for surveillance systems.

In various aspects of the present teachings, the occurrence model describes the object detection probabilities in space and time dimensions. Each element of the occurrence data cube represents the probability of detecting an object at the particular location in the scene at the particular time interval. As can be appreciated, a time plus three dimensional occurrence data cube can be obtained from multiple cameras 20*a*-20*n* (FIG. 2). The velocity model can be similarly built, where each cell of the velocity data cube can represent a Gaussian distribution of (dx,dy) or a mixture of Gaussian distributions.

These parameters can be learned with recursive formulae. Similar to the velocity data cube, each cell of an acceleration data cube stores the Gaussian distribution of ((dx)'.(dy)'). The entry/exit zones model models regions of the scene in which objects are first detected and last detected. These, areas can be modeled by a mixture of Gaussian models. Their location can be generated from first and last track points of each detected object by the application of clustering methods, such as, K-means. Expectation Maximization (EM) methods, etc.

The trajectory models can be built by using the entry and exit regions with the object meta data 30 obtained from the video analysis module 80 (FIG. 2). In various aspects, each entry-exit region defines a segment in the site used by the observed objects in motion. A representation of each segment can be obtained by using curve fitting, regression, etc. methods on object data collected from a camera in real time or simulated. Since each entry and exit region includes time interval, the segments also include an associated time interval.

The directional models represent the motion of an object with respect to regions in a site. Specifically, each cell contains a probability of following a certain direction in the cell and a statistical representation of measurements in a spatio temporal region (cell), such as speed and acceleration. A cell can contain links to entry regions, exit regions, trajectory models, and global data cube model of site under surveillance. A cell can contain spatio temporal region specific optimized scoring engine methods as well as user specified scoring engine methods. Although the dimensions of the data cube are depicted as a uniform grid structure, it is appreciated that non-uniform intervals can be important for optimal model representation. The variable length intervals, as well as clustered/segmented non-rigid spatio temporal shape descriptors (i.e., 3D/4D shape descriptions), can be used for model reduction. Furthermore, the storage of the model 32 can utilize multi-dimensional indexing methods (such as R-tree, X-tree, SR-tree, etc.) for efficient access to cells.

As can be appreciated, the data cube structure supports predictive modeling of the statistical attributes in each cell so that the a motion trajectory of an observed object can be predicted based on the velocity and acceleration attributes stored in the data cube. For example, based on a statistical analysis of the past history of motion objects, any object detected in location (X1, Y1) may be highly likely to move to location (X2, Y2) after T seconds based on historical data. When a new object is observed in location (X1, Y1) it is likely to move to location (X2, Y2) after T seconds.

Figure 5:
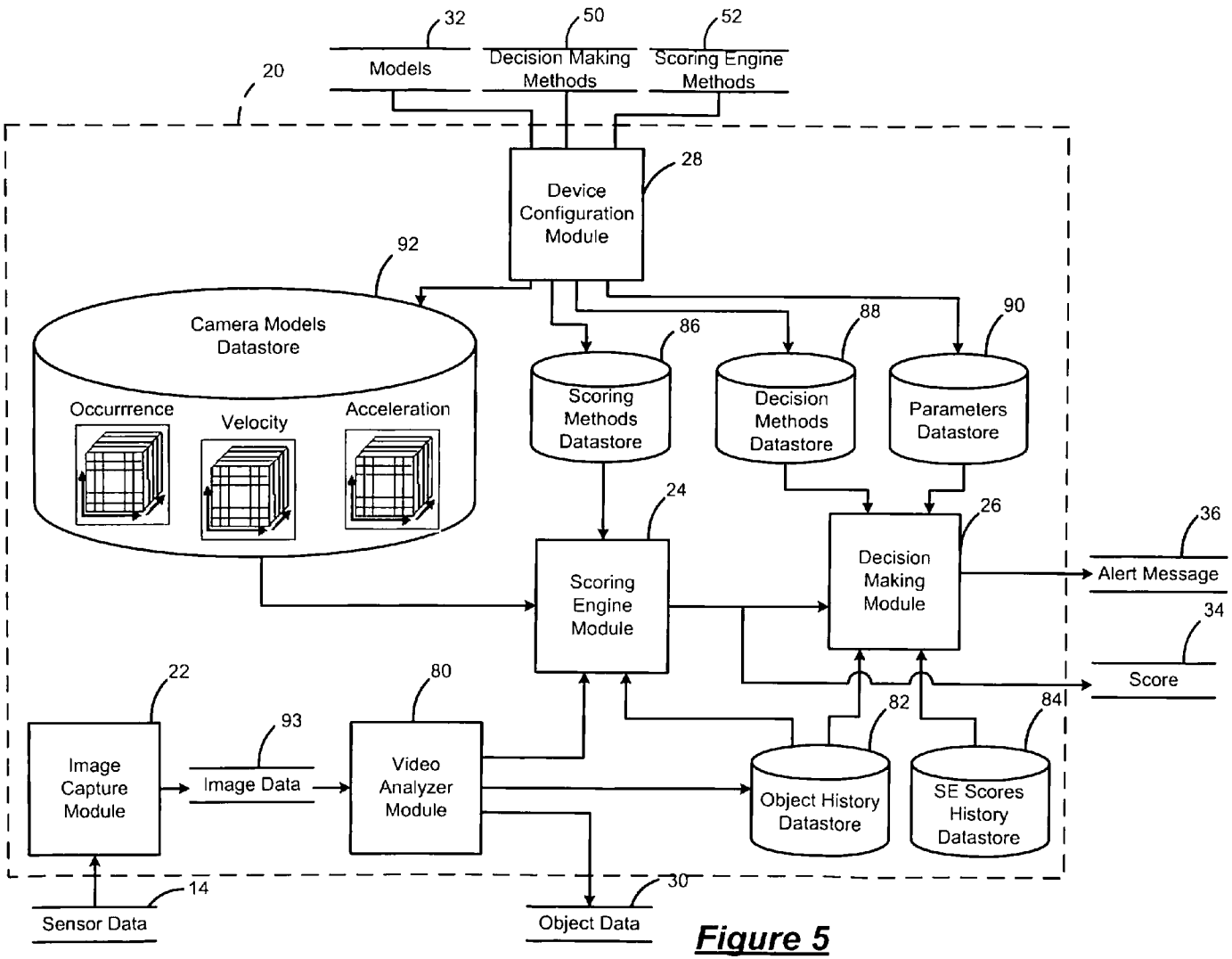
FIG. 5 is a dataflow diagram illustrating an exemplary camera of the surveillance system according to various aspects of the present teachings.

Referring now to FIG. 5, a diagram illustrates a more detailed exemplary camera 20 of the surveillance system 10 according to various aspects of the present teachings. The camera 20, as shown, includes the image capture module 22, a video analyzer module 80, the scoring engine module 24, the decision making module 26, the device configuration module 28, an object history datastore 82, a camera models datastore 92, a scoring engine scores history datastore 84, a parameters datastore 90, a decision methods datastore 88, and a scoring methods datastore 86.

As discussed above, the image capture module 22 captures image data 93 from the sensor data 14. The image data 93 is passed to the video analyzer module 80 for the extraction of objects and properties of the objects. More particularly, the video analyzer module 80 can produce object data 30 in the form of an object detection vector ($\vec{o}$), that includes: an object identifier (a unique key value per object); a location of a center of an object in the image plane (x,y), a timestamp; a minimum bounding box (MBB) in the image plane (x,low,y, low,x,upper,y,upper): a binary mask matrix that specifies which pixels belong to a detected object; image data of the detected object; and/or some other properties of detected objects such as visual descriptors specified by an Metadata format (i.e. MPEG7 Standard and its extended form for surveillance). The object data 30 can be sent to the scoring engine (SE) modules 24 and saved into the object history datastore 82.

In various aspects of the present teachings, the video analyzer module 80 can access the models 32 of the camera models datastore 92, for example, for improving accuracy of the object tracking methods. As discussed above, the models 32 are loaded to the camera models datastore 92 of the camera 20 via the device configuration module 28. The device configuration module also instantiates the scoring engine module 24, the decision making module 26, and prepares a communication channel between modules involved in the processing of object data 30 for progressive behavior and threat detection.

The scoring engine module 24 produces one or more scores 34 for particular object traits, such as, an occurrence of the object in the scene, a velocity of the object, and an acceleration of the object. In various aspects, the scoring engine module includes a plurality of scoring engine sub-module that performs the following functionality. The scoring engine module 24 selects a particular scoring engine method 52 from the scoring methods datastore 86 based on the model type and the object trait to be scored. Various exemplary scoring engine methods 52 can be found in the attached Appendix A. The scoring engine methods 52 are loaded to the scoring methods datastore 86 via the device configuration module 28

The scores 34 of each detected object can be accumulated to obtain progress threat or alert levels at location (X0, Y0) in real time. Furthermore, using the predictive model stored in the data cube, one can calculate the score 34 of the object in advance by first predicting the motion trajectory of the object and calculate the score of the object along the trajectory. As a result, the system can predict the changing of threat levels before it happens to support preemptive alert message generation. The forward prediction can include the predicted properties of an object in the near future (such as it is location, speed, etc.) as well as the trend analysis of scoring results.

The determination of the score 34 can be based on the models 32, the object data 30, the scores history data 34, and in some cases object history data from the object history datastore 82, the some regions of interest (defined by user), and their various combinations. As can be appreciated, the score 34 can be a scalar value representing the measure of abnormality. In various other aspects of the present teachings the score 34 can include two or more scaler values. For example, the score 34 can include a measure of normalcy and/or a confidence level, and/or a measure of abnormality and/or a confidence level. The score data 34 is passed to the decision making module 26 and/or stored in the SE scores history datastore 84 with a timestamp.

Figure 6:
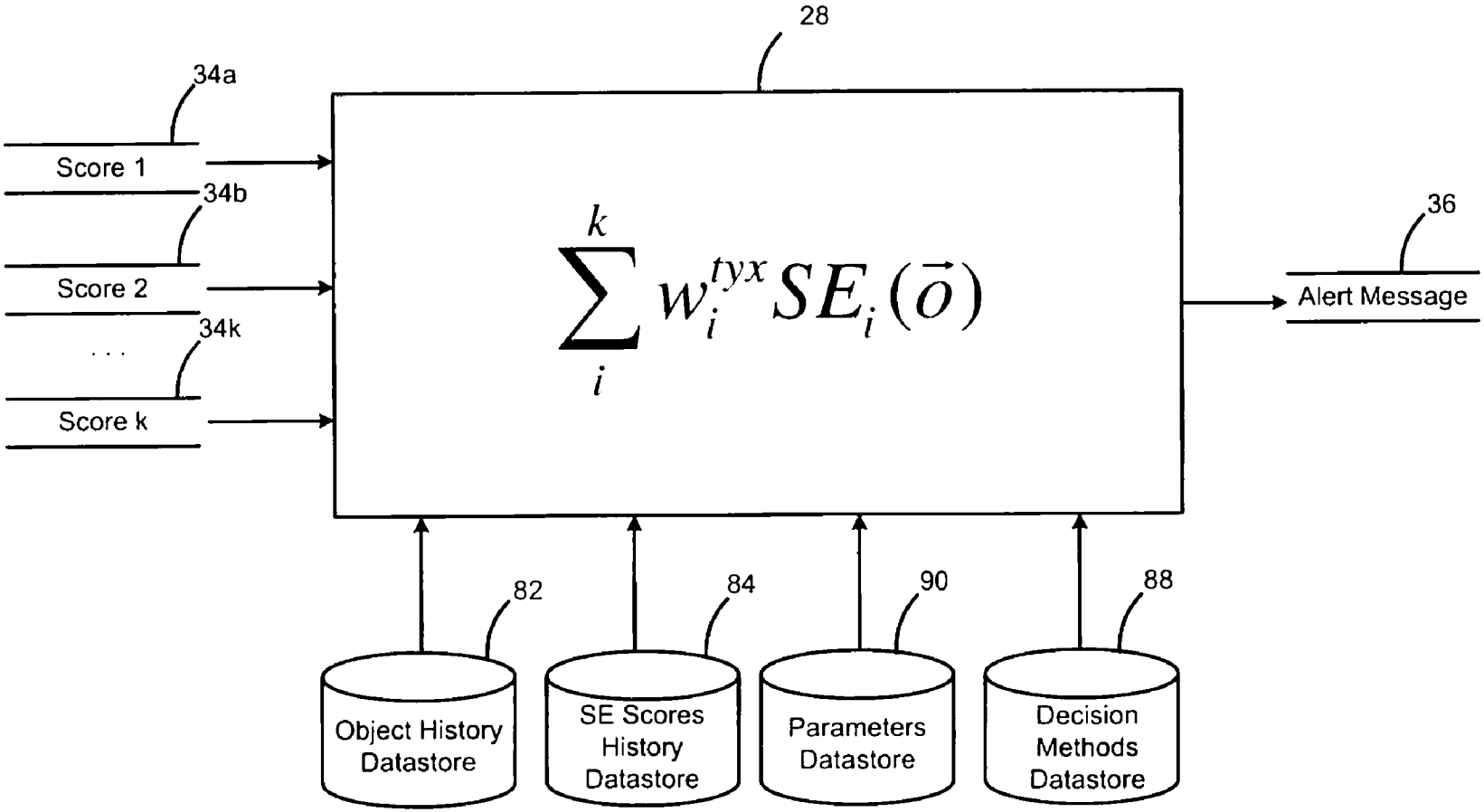
FIG. 6 is a dataflow diagram illustrating an exemplary decision making module of the camera according to various aspects of the present teachings.
Figure 7:
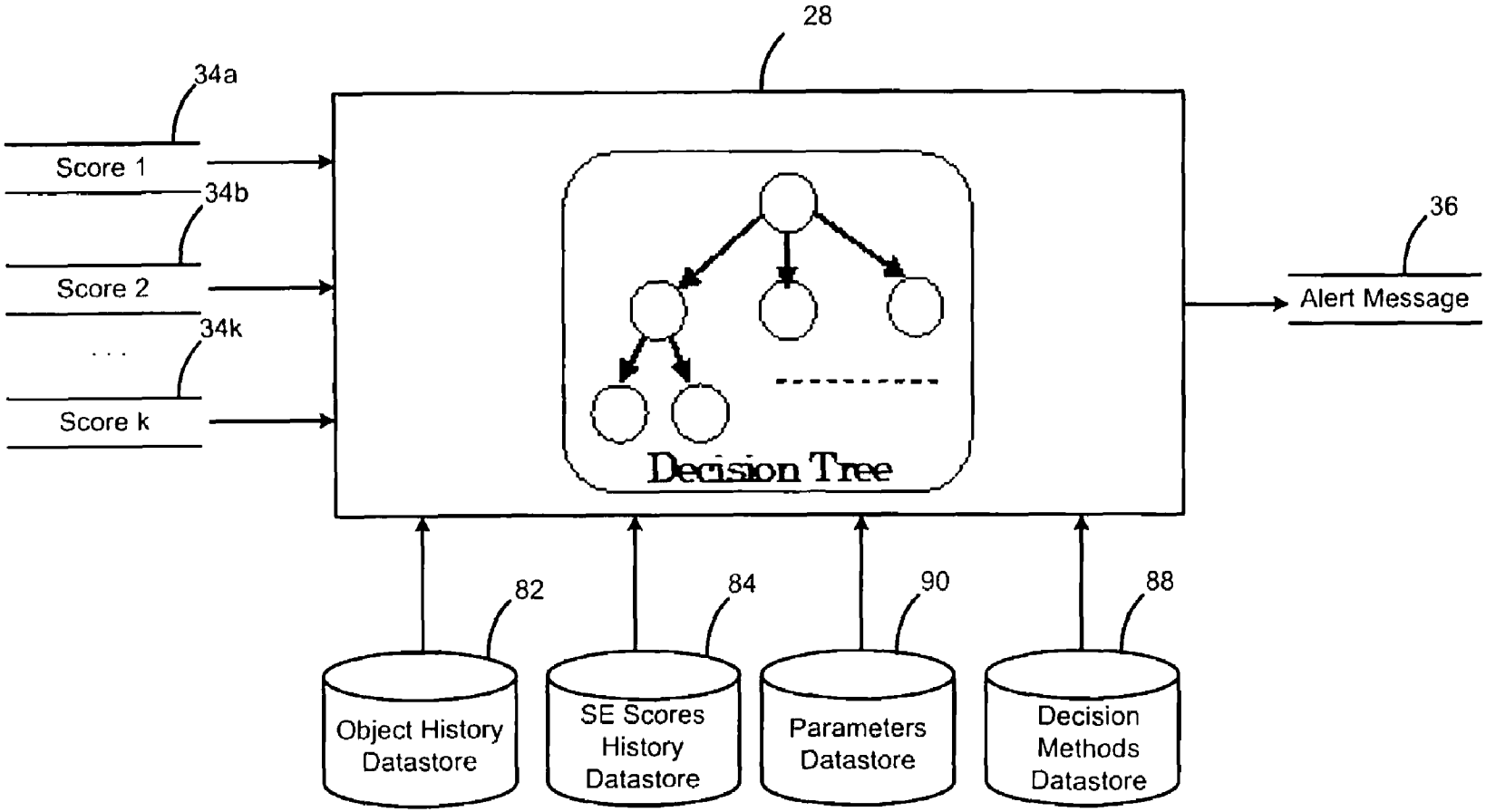
FIG. 7 is a dataflow diagram illustrating another exemplary decision making module of the camera according to various aspects of the present teachings.

The decision making module 26 then generates the alert message 36 based on a fusing of the scores 34 from the scoring engine modules 24 for a given object detection event data ($\vec{o}$). The decision making module can use the historical score data 34, and object data 30 during fusion. The decision making module 26 can be implemented according to various decision making methods 50 stored to the decision methods datastore 88. Such decision making methods 50 can be loaded to the camera 20 via the device configuration module 28. In various aspects of the present teachings, as shown in FIG. 6, the alert message 36 is computed as a function of a summation of weighted scores as shown by the following equation:

$$\sum_{i}^{k} w_i^{txy} SE_i(\vec{o}). \quad (1)$$

Where w represents a weight for each score based on time (t) and spatial dimensions (XY). In various aspects of the present teachings, the dimensions of the data cube can vary in number for example. XYZ spatial dimensions. The weights (w) can be pre-configured or adaptively learned and loaded to the parameters datastore 90 via the device configuration module 28. In various other aspects of the present teachings, the alert message 36 is determined based on a decision tree based method as shown in FIG. 7. The decision tree based method can be adaptively learned throughout the surveillance process.

Since the decision making module 26 can be implemented according to various decision making methods 50, the decision making module is preferable defined in a declarative form by using, for example, XML based representation such as an extended form of the Predictive Model Markup Language. This enables the Learning Module 44 to improve the decision making module accuracy since the learning module 44 changes various parameters (such as weight and the decision tree as explained above) and the decision making method also.

In various aspects of the present teachings, the decision making module 26 can generate predictions that can generate early-warning alert messages for progressive behavior and threat detection. For example, the decision making module 26 can generate predications about objects in motion based on the trajectory models 32. A prediction of a future location of an object in motion enables the decision making module 26 to identify whether two objects in motion will collide. If the collision is probable, the decision making module 26 can predict where objects will collide and when objects will collide as well as generate the alert message 36 to prevent a possible accident.

As discussed above, to allow for co-operative decision making between cameras 20*a*-20*n* in the surveillance system 10, the decision making module 26 can exchange data with other decision making modules 26 such as decision make modules 26 running in other cameras 20*a*, 20*b* (FIG. 2) or devices. The object data 30 and the scores 34 of suspicious objects detected by other cameras 20*a*, 20*b* (FIG. 2) can be stored to the object history datastore 82 and the SE scores history datastore 84, respectively. Thus, providing a history of the suspicious object to improve the analysis by the decision making module 26.

Figure 8:
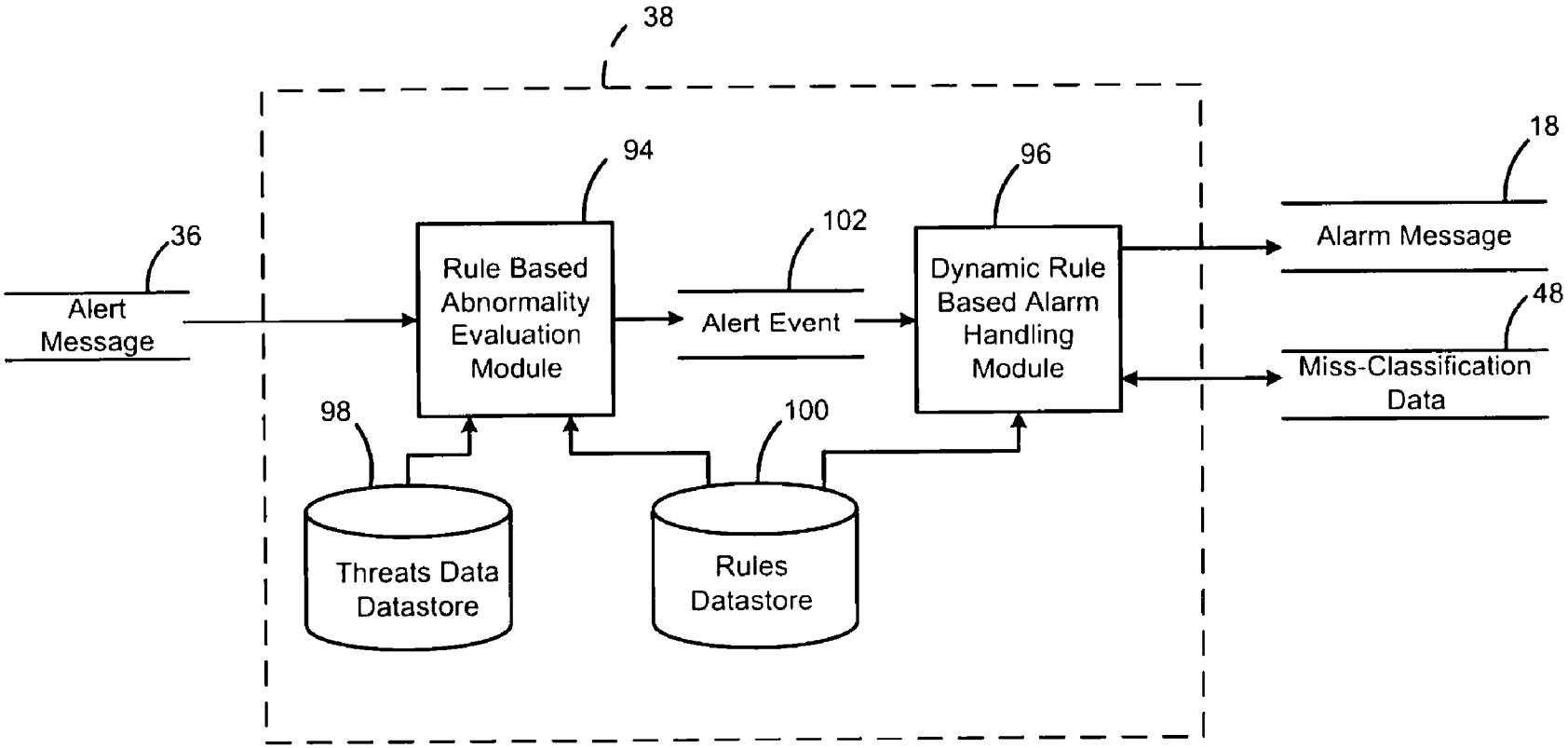
FIG. 8 is a dataflow diagram illustrating an exemplary alarm handling module of the surveillance system according to various aspects of the present teachings.

Referring now to FIG. 8, a dataflow diagram illustrates a more detailed exemplary alarm handling module 38 of the surveillance system 10 according to various aspects of the present teachings. The alarm handling module 38 collects alert messages 36 and creates a "threat" structure for each new detected object. The threat structure maintains the temporal properties associated with the detected object as well as associates other pre-stored properties and obtained properties (such as the result of face recognition) with the detected object. The alarm handling module 38 re-evaluates the received alert messages 36 by using the collected properties of objects in the threat structure and additional system configuration to decide the level of alarm. The alarm handling module can filter the alert message without generating any alarm, as well as increase the alarm level if desired.

More particularly, the alarm handling module 38 can include a threats data datastore 98, a rule based abnormality evaluation module 94, a rules datastore 100, and a dynamic rule based alarm handling module 96. As can be appreciated, the rule based abnormality evaluation module 94 can be considered another form of a decision making module 26 (FIG. 2) defined within a sensor device. Therefore, all explanations/operations associated with the decision making module 26 are applicable to the rule based abnormality evaluation module 94. For example, the decision making for the rule based abnormality evaluation module 94 can be declaratively defined in an extended form of Predictive Model Markup Language for surveillance. The threats data datastore 98 stores the object data scores 34, and additional properties that can be associated with an identified object. Such additional properties can be applicable to identifying a particular threat and may include, but are not limited to: identity recognition characteristics of a person or item, such as, facial recognition characteristics or a license plate number; and object attributes such as an employment position or a criminal identity.

The rules datastore 100 stores rules that are dynamically configurable and that can be used to further evaluate the detected object. Such evaluation rules, for example, can include, but are not limited to, rules identifying permissible objects even though they are identified as suspicious; rules associating higher alert levels with recognized objects; and rules recognizing an object as suspicious when the object is present in two different scenes at the same time.

The rule based abnormality evaluation module 94 associates the additional properties with the detected object based on the object data from the threats data datastore 98. The rule based abnormality evaluation module 94 then uses this additional information and the evaluation rules to re-evaluate the potential threat and the corresponding alert level. For example, the rule based abnormality evaluation module 94 can identify the object as a security guard traversing the scene during off-work hours. Based on the configurable rules and actions, the rule based abnormality evaluation module 94 can disregard the alert message 36 and prevent the alarm messages 18 from being dispatched even though a detection of a person at off-work hours is suspicious.

The dynamic rule based alarm handling module 96 dispatches an alert event 102 in the form of the alarm messages 18 and its additional data to interested modules, such as, the surveillance GUI 40 (FIG. 2) and/or an alarm logging module (not shown). When the dynamic rule based alarm handling module 96 dispatches the alarm messages 18 via the surveillance GUI 40, the user can provide additional feedback by agreeing or disagreeing with the alarm. The feedback is provided by the user as miss-classification data 48 to the learning module 44 (FIG. 2) in the form of agreed or disagreed cases. This allows the surveillance system 10 to collect a set of data for further optimization of system components (i.e., models 32, scoring engine methods 52, decision making methods 50, rules, etc. (FIG. 2)).

Figure 9:
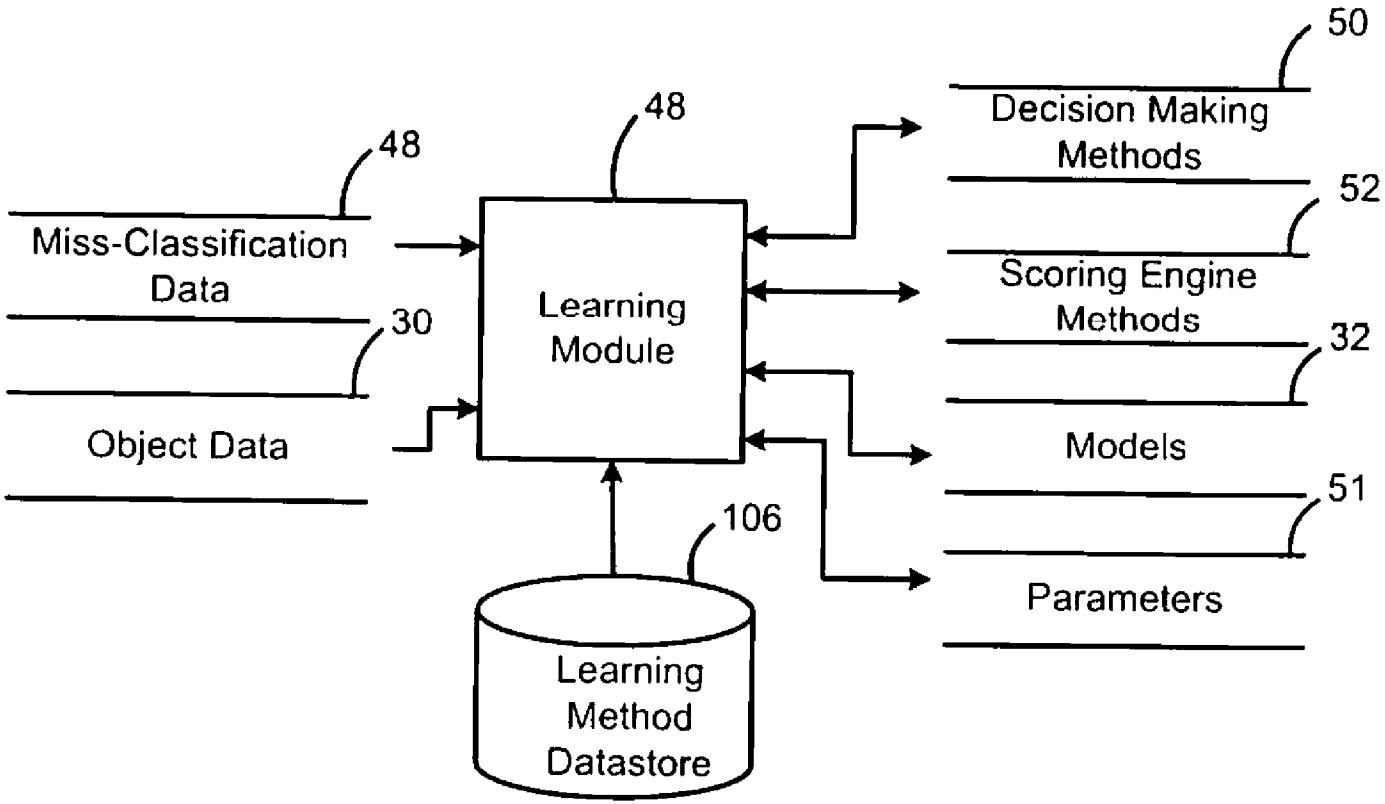
FIG. 9 is a dataflow diagram illustrating an exemplary learning module of the surveillance system according to various aspects of the present teachings.

Referring now to FIG. 9, a dataflow diagram illustrates a more detailed exemplary learning module 44 of the surveillance system 10 according to various aspects of the present teachings. The learning module 44 optimizes the scoring engine methods 52, the decision making methods 50, and the associated parameters 51, such as, the spatio-temporal weights based on the learned miss-classification data 48.

For example, the learning module 44 retrieves the decision making methods 50, the models 32, the scoring engine methods 52, and the parameters 51 from the system configuration module 42. The learning module 44 selects one or more appropriate learning methods from a learning method datastore 106. The learning methods can be associated with a particular decision making method 50. Based on the learning method, the learning module 44 re-examines the decision making method 50 and the object data 30 from a camera against the miss-classification data 48. The learning module can adjust the parameters 51 to minimize the error in the decision making operation. As can be appreciated, if more than one learning method is associated with the decision making method 50, the learning module 44 performs the above re-examination for each method 50 and uses a best result or some combination thereof to adjust the parameters 51.

Figure 10:
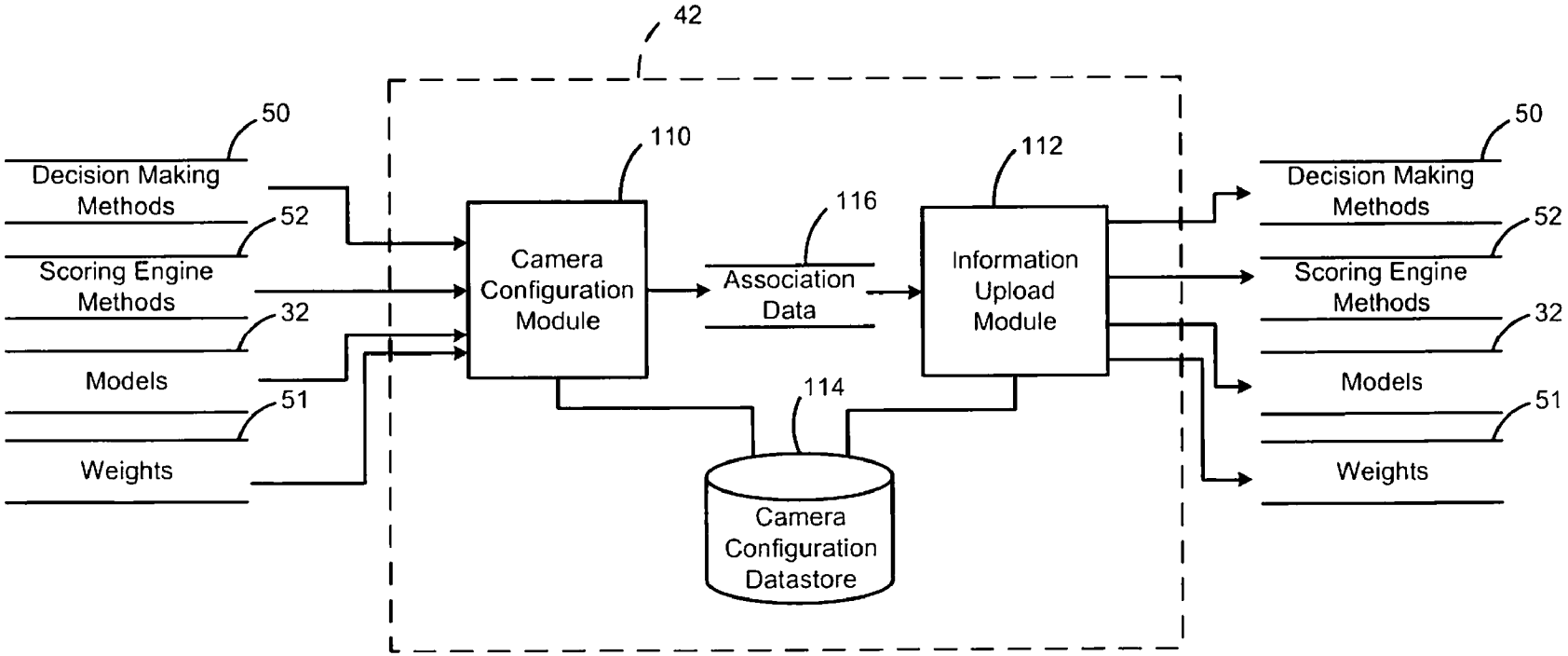
FIG. 10 is a dataflow diagram illustrating an exemplary system configuration module of the surveillance system according to various aspects of the present teachings.

Referring now to FIG. 10, a dataflow diagram illustrates a more detailed exemplary system configuration module 42 of the surveillance system 10 according to various aspects of the present teachings. The system configuration module 42, as shown, includes a camera configuration module 110, an information upload module 112, and a camera configuration datastore 114.

The camera configuration module 110 associates the models 32, the scoring engine methods 52, and the decision making methods 50 and parameters 51 with each of the cameras 20*a*-20*n* (FIG. 2) in the surveillance system 10. The camera configuration module 110 can accept and associate additional system configuration data from the camera configuration datastore 114, such as, user accounts and network level information about devices in the system (such as cameras, encoders, recorders, IRIS recognition devices, etc.). The camera configuration module 110 generates association data 116.

The information upload module 112 provides the models 32, the scoring engine methods 52, and the decision making methods 50 and parameters 51 to the device configuration module 28 (FIG. 2) based on the association date 116 of the cameras 20*a*-20*n* (FIG. 2) upon request. In various aspects of the present teachings, the information upload module 112 can be configured to provide the models 32, the scoring engine methods 52, the decision making methods 50 and parameters 51 to the device configuration module 28 (FIG. 2) of the cameras 20*a*-20*n* at scheduled intervals.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, specification, and the following claims.

What is claimed is:

1. A surveillance system, comprising:

a data capture module collecting sensor data, wherein the sensor data includes video surveillance footage of an object being monitored;

a scoring engine module receiving the sensor data and computing at least one of an abnormality score and a normalcy score based on the sensor data, at least one dynamically loaded learned data model, and a plurality of learned scoring methods, wherein each learned scoring method generates a subscore used to compute the at least one of the abnormality score and the normalcy score, and wherein the abnormality score and the normalcy score indicate an amount of divergence or adherence to the at least one dynamically loaded learned data model by the object being monitored; and a decision making module receiving the at least one of the abnormality score and the normalcy score and generating an alert message based on the at least one of the abnormality score and the normalcy score and a learned decision making method to produce progressive behavior and threat detection.

2. The surveillance system of claim 1 further comprising a device configuration module automatically loading the learned scoring methods, the learned decision making methods, and the learned model to at least one of the scoring engine module and the decision making module.

3. The surveillance system of claim 1 further comprising a model builder module adaptively learning the model and wherein the scoring engine module computes the at least one of the abnormality score and the normalcy score based on the adaptively learned models.

4. The surveillance system of claim 1 further comprising a model builder module building the model based on at least one of a simulation of the sensor data and accumulated sensor data.

5. The surveillance system of claim 4 further comprising a graphical user interface accepting parameters from a user to generate the simulation.

6. The surveillance system of claim 1 wherein the learned scoring method calculates an observed property of objects in motion against the model stored in a data cube to obtain a set of scores representing at least one of similarity and difference scores between an object in motion and the learned model.

7. The surveillance system of claim 6 wherein the at least one of the similarity and difference scores are accumulated and normalized for the object in motion, to represent the at least on of normalcy and abnormality scores.

8. The surveillance system of claim 1 further comprising a learning module adaptively learning at least one of the scoring methods, the decision making methods, and the learned model.

9. The surveillance system of claim 1 further comprising an alarm handling module receiving the alert message and generates an alarm message based on a further examination of the alert message.

10. The surveillance system of claim 1 wherein the data capture module collects sensor data from an image sensor and extracts object data from the sensor data, and wherein the scoring engine module computes the at least one of the abnormality score and the normalcy score based on the object data.

11. The surveillance system of claim 1 wherein the decision making module receives at least one of an abnormality score and a normalcy score generated from other sensor data and generates an alert message based on the at least one of the abnormality score and the normalcy score generated from the other sensor data.

12. The surveillance system of claim 1 wherein each learned scoring method has a weight associated therewith, and wherein the scoring engine computes a weighted average of the subscores using the weights associated with each learned scoring method.

13. The surveillance system of claim 1 wherein each learned scoring method analyzes a different type of behavior of the object being monitored, wherein a score associated with a particular scoring method indicates a degree of normalcy or abnormality given the type of behavior being analyzed.

14. A surveillance system, comprising:

a plurality of image sensing devices, wherein the image sensing devices each include:

a data capture module collecting sensor data, wherein the sensor data includes video surveillance footage of an object being monitored;

a scoring engine module receiving the sensor data and computing at least one of an abnormality score and a normalcy score based on the sensor data, at least one dynamically loaded data model, and a plurality of learned scoring methods, wherein each learned scoring method generates a subscore used to compute the at least one of the abnormality score and the normalcy score, and wherein the abnormality score and the normalcy score indicate an amount of divergence or adherence to the at least one dynamically loaded learned data model by the object being monitored, and wherein each learned scoring method analyzes a different type of behavior of the object being monitored; and a decision making module receiving the at least one of the abnormality score and the normalcy score and generating an alert message based on the at least one of the abnormality score and the normalcy score and a learned decision making method to produce progressive behavior and threat detection.

15. The surveillance system of claim 14 wherein the decision making module of a first image sensing device receives the at least one of the abnormality score and the normalcy score from a second image sensing device, and wherein the decision making module of the first image sensing device generates the alert message based on the at least one of the abnormality score and the normalcy score from the second image sensing device.

16. The surveillance system of claim 14 further comprising a model builder module adaptively learning the predetermined models.

17. The surveillance system of claim 14 wherein the image sensing devices each further include a device configuration automatically loading updated scoring methods, decision making methods, and the learned models to the image sensing device.

18. The surveillance system of claim 14 further comprising a model builder module building models based on a simulation of the sensor data and accumulated real sensor data.

19. The surveillance system of claim 18 further comprising a graphical user interface accepting motion parameters from a user to generate the simulation.

20. The surveillance system of claim 14 further comprising a learning module adaptively learning a decision making method and wherein the decision making method is selectively loaded to at least one of the plurality of image sensing devices.

21. The surveillance system of claim 14 further comprising an alarm handling module receiving the alert messages from the plurality of image sensing devices and generating an alarm message based on a further examination of the alert messages.

22. A surveillance method, comprising:

receiving sensor data, wherein the sensor data includes video surveillance footage of an object being monitored;

dynamically loading data models;

computing at least one of an abnormality score and a normalcy score based on the sensor data, a plurality of learned scoring methods, and the dynamically loaded data models, wherein each learned scoring method generates a subscore used to compute the at least one of the abnormality score and the normalcy score, and wherein the abnormality score and the normalcy score indicate an amount of divergence or adherence to the at least one dynamically loaded learned data model by the object being monitored, and wherein each learned scoring method analyzes a different type of behavior of the object being monitored; and generating an alert message based on the at least one of the abnormality score and the normalcy score.

23. The surveillance method of claim 22 further comprising selectively loading at least one of scoring methods and decision making methods to be used by at least one of the computing and the generating.

24. The surveillance method of claim 22 further comprising:

adaptively learning the data models, and wherein the computing comprises computing the at least one of the abnormality score and the normalcy score based on the adaptively learned data models.

25. The surveillance method of claim 22 further comprising building the model based on a simulation of the sensor data.

26. The surveillance method of claim 22 further comprising:

adaptively learning a decision making method, and wherein the generating comprises generating the alert message based on the adaptively learned decision making method.

27. The surveillance method of claim 22 further comprising:

further examining the alert message; and generating an alarm message based on the further examining.

28. The surveillance method of claim 22 wherein the receiving comprises receiving sensor data from an image sensor.

29. The surveillance method of claim 28 further comprising:

extracting object data from the sensor data, and wherein the computing further comprises computing the at least one of the abnormality score and the normalcy score based on the object data.

* * * * *